US007478595B1

(12) United States Patent
Herr et al.

(10) Patent No.: US 7,478,595 B1
(45) Date of Patent: Jan. 20, 2009

(54) BASE MOUNTED AIRBURST FUZE FOR PROJECTILE

(75) Inventors: Frederick B. Herr, Fairview, NJ (US); David G. Tabao, East Hanover, NJ (US); Alan C. Reiter, Gaithersburg, MD (US); Thomas Skokos, Wharton, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 431 days.

(21) Appl. No.: 11/163,031

(22) Filed: Oct. 3, 2005

(51) Int. Cl.
*F42C 15/26* (2006.01)

(52) U.S. Cl. ..... 102/235; 102/244; 102/249; 102/501

(58) Field of Classification Search ..... 102/221, 102/231–235, 237–239, 244–245, 247–249, 102/251–252, 254–256, 396–397, 501
See application file for complete search history.

(56) References Cited

U.S. PATENT DOCUMENTS 3,580,177 A * 5/1971 Krahulec ..... 102/244
5,056,434 A * 10/1991 Patel et al. ..... 102/238
5,131,328 A * 7/1992 Chan ..... 102/229
5,705,766 A * 1/1998 Farace et al. ..... 102/215
6,401,621 B1 * 6/2002 Davis et al. ..... 102/232
6,622,629 B2 * 9/2003 Hodge et al. ..... 102/235
7,055,437 B1 * 6/2006 Robinson et al. ..... 102/222

* cited by examiner

*Primary Examiner*—Michelle Clement
(74) *Attorney, Agent, or Firm*—Michael C. Sachs

(57) ABSTRACT

A projectile comprises a payload portion and an airburst fuze mounted on a rear of the projectile and explosively connected to the payload portion. The airburst fuze comprises an arming and firing electrical circuit including a setback generator; a slider that is movable from a safe position to an armed position, the slider including a detonator attached thereto; a setback lock and a spin lock that lock the slider in the safe position and, in response to a setback acceleration and a spin rate, respectively, unlock the slider; and an actuator that moves the slider to the armed position in response to a first input from the arming and firing electrical circuit; wherein a second input from the arming and firing circuit activates the detonator when the slider is in the armed position.

8 Claims, 4 Drawing Sheets

BASE MOUNTED AIRBURST FUZE FOR PROJECTILE

STATEMENT OF GOVERNMENT INTEREST

The inventions described herein may be manufactured, used and licensed by or for the U.S. Government for U.S. Government purposes.

BACKGROUND OF THE INVENTION

The invention relates in general to airborne munitions and, in particular, to a fuze that is mounted on the base of an airborne projectile.

U.S. Army studies have shown that the effectiveness of munitions, in particular, medium caliber munitions, can be greatly improved by an airbursting function. Presently, there is no medium caliber ammunition in the U.S. Army inventory that is capable of airburst using a base mounted fuze. The known medium caliber fuzes function on impact rather than airburst. A base mounted fuze is desirable because moving the fuze from the nose to the base has been shown to increase a weapon's lethality.

The present invention provides a base mounted fuze having an airburst function. While the impetus for the invention arose with regard to medium caliber ammunition, the invention is also applicable to large caliber ammunition and to small caliber ammunition, where space permits.

SUMMARY OF THE INVENTION

It is an object of the invention to provide a base mounted airburst fuze for a medium caliber projectile.

It is another object of the invention to provide base mounted airburst fuze that functions on a time delay.

One aspect of the invention is a projectile comprising a payload portion; and an airburst fuze mounted on a rear of the projectile and explosively connected to the payload portion.

The airburst fuze comprises an arming and firing electrical circuit including a setback generator; a slider that is movable from a safe position to an armed position, the slider including a detonator attached thereto; a setback lock and a spin lock that lock the slider in the safe position and, in response to a setback acceleration and a spin rate, respectively, unlock the slider; and an actuator that moves the slider to the armed position in response to a first input from the arming and firing electrical circuit; wherein a second input from the arming and firing circuit activates the detonator when the slider is in the armed position.

Preferably, the size of the projectile is in a range of about 20 mm to about 60 mm. The setback generator begins to provide voltage to the arming and firing electrical circuit when the fuze undergoes setback acceleration of at least 10,000 g. The setback and spin locks are held in an unlocked position by centrifugal force. A time delay for arming is varied by varying a resistor in an arming portion of the arming and firing circuit and a time delay for firing is varied by varying a resistor in a firing portion of the arming and firing circuit.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
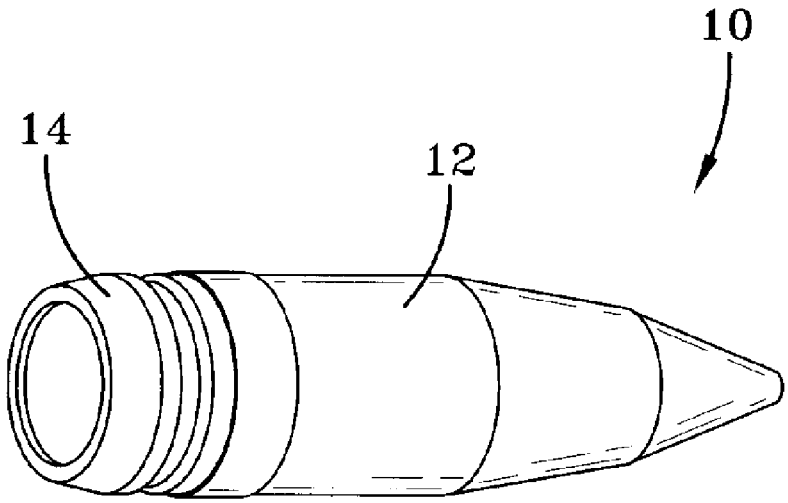
FIG. 1 is a side view of a projectile.

FIG. 1 is a side view of a projectile 10 having a payload 12 and a base mounted fuze 14. Projectile 10 is primarily a medium caliber projectile, for example, in the range of 20 mm to 60 mm. The invention, however, is also applicable to smaller and larger projectiles. The payload 12 is generally an explosive payload that is detonated by the base mounted fuze 14. Fuze 14 is designed to detonate payload 12 while projectile 10 is airborne.

Figure 2:
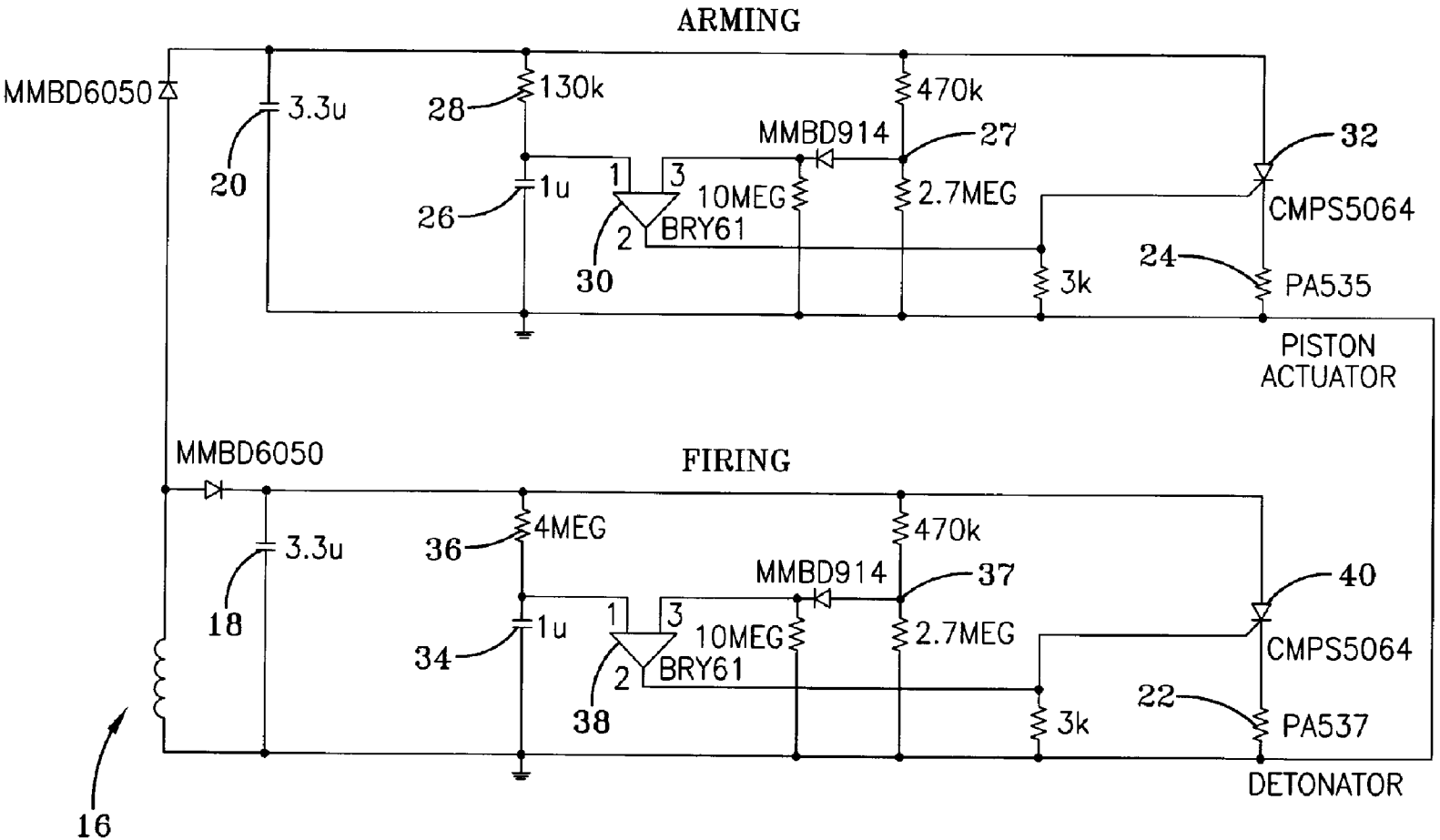
FIG. 2 is a circuit diagram showing an example of an arming and firing circuit.

Fuze 14 comprises electrical and mechanical components. The electrical components include two nearly identical timing circuits with the difference being the time delay each circuit provides. The arming circuit provides the time to arm the safety and arming device and the firing circuit provides the fuze's functioning time. FIG. 2 is a circuit diagram showing the arming and firing circuits. Next to each circuit component in FIG. 2 is an exemplary specification for that component.

Referring to FIG. 2, when the fuze 14 experiences at least 10,000 g setback force a setback generator 16 provides voltage to the two capacitors 18, 20. The voltage supplied to the capacitors 18, 20 powers the arming and firing circuits and provides energy for firing the explosive devices 22, 24 at their set times. The arming time delay is accomplished as capacitor 20 discharges into capacitor 26 through resistor 28. When the voltage on capacitor 26 reaches the voltage at node 27 the programmable unijunction transistor 30 conducts, pulsing the gate of the silicon controlled rectifier 32. This action causes the silicon controlled rectifier 32 to conduct. This action, in turn, allows the voltage left on capacitor 20 to discharge through an actuator 24, such as a piston actuator bridgewire. This causes the actuator 24 to function, thereby arming the fuze 14.

The firing circuit functions in a similar manner as described for the arming circuit except that the delay time is longer. The firing delay time corresponds to the range or distance at which the user desires the round to function. The firing time delay is accomplished as capacitor 18 discharges into capacitor 34 through resistor 36. When the voltage on capacitor 34 reaches the voltage at node 37 the programmable unijunction transistor 38 conducts, pulsing the gate of the silicon controlled rectifier 40. This action causes the silicon controlled rectifier 40 to conduct. This action, in turn, allows the voltage left on capacitor 18 to discharge through a detonator 22.

The delay times for the arming and firing circuits are set by choosing appropriate values for resistors 28 and 36, respectively.

Figure 3:
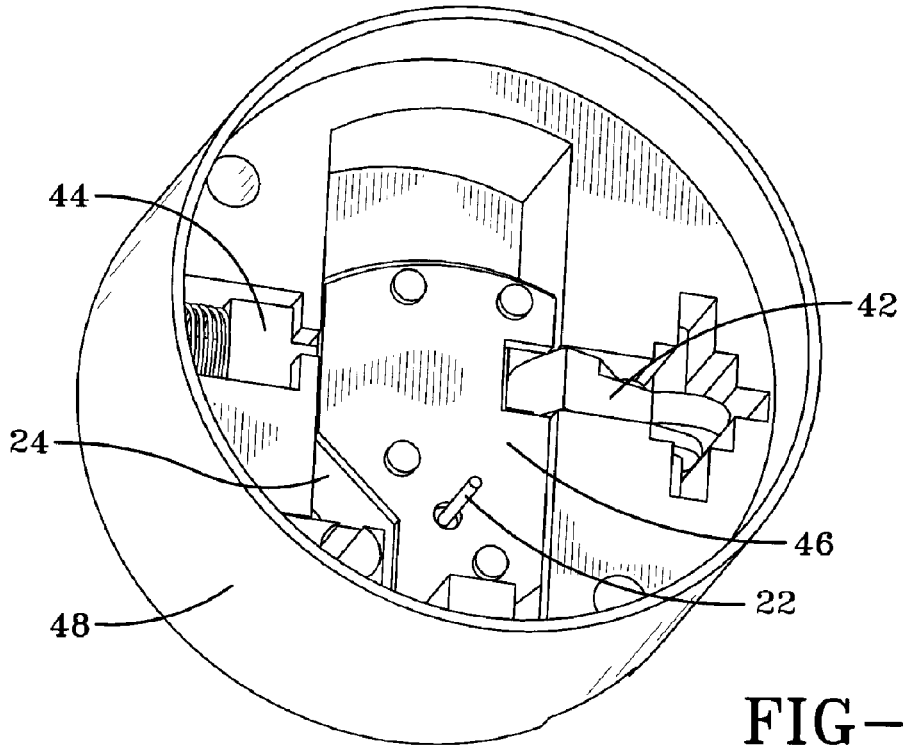
FIG. 3 shows mechanical features of the fuze in a safe condition.
Figure 4:
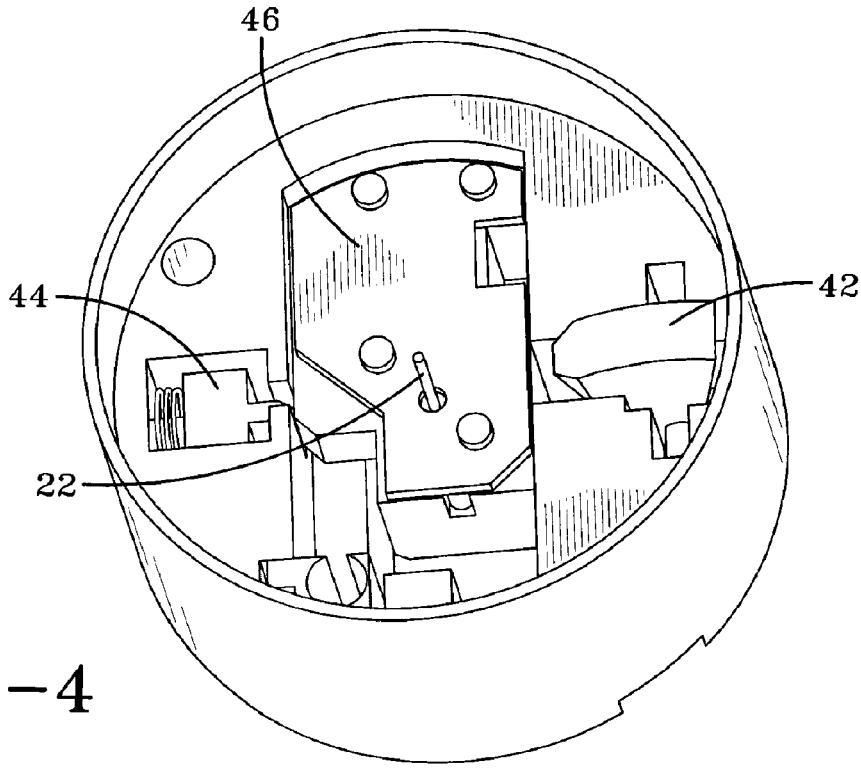
FIG. 4 shows the fuze of FIG. 3 in an armed condition.

FIG. 3 shows mechanical features of the fuze 14 in a safe condition. FIG. 4 shows the fuze 14 of FIG. 3 in an armed condition. Fuze 14 is disposed in a mechanical housing 48. The maximum anticipated setback acceleration and maximum anticipated spin rate of medium caliber rounds are 100,000 g and 100,000 rpm, respectively. Upon launch of the projectile 10, the setback lock 42 and spin lock 44 are disengaged. Both locks are held in the unlocked position by centrifugal force. Simultaneously, the setback generator 16 is activated and provides electrical energy to be stored in the capacitors in the arming and firing circuit, as described previously.

Figure 5:
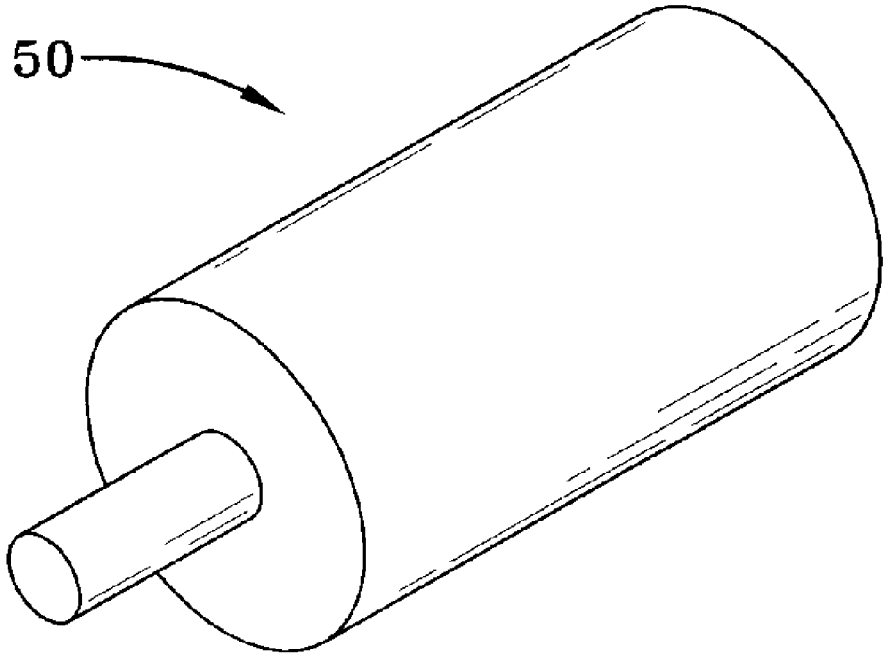
FIG. 5 shows a piston actuator.

At a preset arming time delay, the energy remaining on capacitor 20 (FIG. 2) is used to activate the actuator 24, which may be a piston type actuator 50 (FIG. 5). The actuator 24 pushes the slider 46 forward and puts the detonator 22 in-line with the payload explosive train 12, thereby arming the fuze 14. The slider contains the detonator 22, for example a PA537 detonator. The energy remaining on capacitor 18 is used to activate the detonator 22 at a later preset firing time delay. The detonator 22 initiates, for example, a lead charge (PBXN-5) which in turn initiates a main charge, for example, PAX-2A, thereby functioning the round.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A projectile, comprising payload portion for housing a payload; and an airburst fuze mounted on a rear of the projectile and explosively connected to the payload portion;

the airburst fuze comprising:

an arming and firing electrical circuit including a setback generator;

a slider that is movable from a safe position to an armed position, the slider including a detonator attached thereto;

a setback lock and a spin lock that lock the slider in the safe position and, in response to a setback acceleration and a spin rate, respectively, unlock the slider;

an actuator that moves the slider to the armed position in response to a first input from the arming and firing electrical circuit;

wherein a second input from the arming and firing circuit activates the detonator when the slider is in the armed position;

wherein the arming and firing electrical circuit further includes an arming circuit for providing a time to arm a safety and arming device, and a firing circuit for providing a fuze functioning time;

wherein the arming circuit provides a first time delay;

wherein the firing circuit provides a second time delay that is longer than the first time delay;

wherein the setback generator provides power to a first capacitor for powering the arming circuit, and further provides power to a second capacitor for powering the firing circuit;

wherein the first time delay is accomplished as the first capacitor discharges through the actuator, causing the actuator to function for arming the airburst fuze;

wherein the second time delay is accomplished as the second capacitor discharges through the detonator, causing the actuator to causing the payload to detonate during flight, when the slider is in the armed position.

2. The projectile of claim 1 wherein the actuator comprises a piston actuator.

3. The projectile of claim 1 wherein a size of the projectile is in a range of about 20 mm to about 60 mm.

4. The projectile of claim 1 wherein the setback generator begins to provide voltage to the arming and firing electrical circuit when the fuze undergoes setback acceleration of at least 10,000 g.

5. The projectile of claim 1 wherein the setback and spin locks are held in an unlocked position by centrifugal force.

6. The projectile of claim 1 wherein a time delay for arming is varied by varying a resistor in an arming portion of the arming and firing circuit and a time delay for firing is varied by varying a resistor in a firing portion of the arming and firing circuit.

7. The projectile of claim 1, wherein the first time delay is variable.

8. The projectile of claim 1, wherein the second time delay is variable.

* * * * *